US008245365B2

(12) United States Patent
Wihlborg

(10) Patent No.: US 8,245,365 B2
(45) Date of Patent: Aug. 21, 2012

(54) SLEEVE COVER FOR SLIDER

(75) Inventor: Lars Wihlborg, Stratford, CT (US)

(73) Assignee: Illinois Tool Works Inc., Glenview, IL (US)

( * ) Notice: Subject to any disclaimer, the term of this patent is extended or adjusted under 35 U.S.C. 154(b) by 1394 days.

(21) Appl. No.: 11/020,607

(22) Filed: Dec. 23, 2004

(65) Prior Publication Data

US 2006/0137147 A1 Jun. 29, 2006

(51) Int. Cl.
*A44B 19/26* (2006.01)

(52) U.S. Cl. ..... 24/415

(58) Field of Classification Search ..... 24/399, 24/400, 415, 429–431; 156/66; 383/64; 264/259; 53/412, 133.4, 139.2, 426; 493/213, 493/21, 927, 929

See application file for complete search history.

(56) References Cited

U.S. PATENT DOCUMENTS

| | | | | |
|---|---|---|---|---|
| 3,986,914 | A | 10/1976 | Howard et al. | |
| 5,871,281 | A * | 2/1999 | Stolmeier et al. | 383/64 |
| 7,004,629 | B2 * | 2/2006 | Shrader et al. | 383/23 |
| 2001/0043762 | A1 | 11/2001 | Cappel et al. | |
| 2003/0000051 | A1 * | 1/2003 | Aoshima et al. | 24/415 |
| 2003/0192151 | A1 | 10/2003 | Metzger | |
| 2004/0161173 | A1 | 8/2004 | Linton et al. | |
| 2004/0187274 | A1 * | 9/2004 | Turvey et al. | 24/415 |
| 2005/0251974 | A1 * | 11/2005 | Baker | 24/418 |

FOREIGN PATENT DOCUMENTS

EP 0 390 585 A 10/1990

* cited by examiner

*Primary Examiner* — James Brittain

(74) *Attorney, Agent, or Firm* — McCarter & English, LLP

(57) ABSTRACT

The disclosure pertains to a sleeve cover for a slider clip which is used for such applications as high pressure pasteurization wherein high pressure is applied to a reclosable bag, including a zipper and slider, which typically includes foodstuffs such as meat products. The sleeve cover is molded, glued or otherwise attached, to the slider to prevent the film of the bag from pressing against and entering the interstices between the slider and the zipper profile and subsequently deforming, pinching or rupturing.

10 Claims, 1 Drawing Sheet

SLEEVE COVER FOR SLIDER

BACKGROUND OF THE INVENTION

1. Field of the Invention

The present invention pertains to a sleeve cover for a slider which is used for such applications as high pressure pasteurization wherein high pressure is applied to a reclosable bag, including a zipper and slider. The sleeve cover is molded, or otherwise attached, to the slider to prevent the film of the bag from pressing against and entering the interstices between the slider and the zipper profile and subsequently deforming or rupturing.

2. Description of the Prior Art

In the prior art, reclosable bags with walls made from film or web, and further including a zipper with a slider, are well known. However, due to the low tolerance to heat of the plastic film or web, sterilization or pasteurization of the contents of the bag has been problematic, particularly for the meat packing industry. High pressure pasteurization (HPP), wherein the finished and filled bags are placed into a pressure vessel and exposed to approximately 36,000 pounds per square inch of pressure for a few minutes, has been promising in this regard. However, high pressure pasteurization can be problematic in such applications in that the plastic film or web may be forced into the interstices between the slider and the zipper profiles and deform, pinch or rupture. Particularly due to the very thin profit margins under which the food industry is operating, any increases in package failure can be particularly critical.

OBJECTS AND SUMMARY OF THE INVENTION

It is therefore an object of this invention to prevent the deformation, pinching or rupture of reclosable bag film or web during high pressure pasteurization caused by the film or web being forced into the interstices between the slider and zipper profile.

It is therefore a still further object of this invention to achieve the above object at a very low price.

These and other objects are attained by providing a semi-soft sleeve cover which is molded, glued or otherwise attached to the zipper slider prior to high pressure pasteurization. During high pressure pasteurization, the film is pressed against the sleeve cover thereby changing form or shape. The sleeve cover fills in the interstices between the slider and the zipper profile, and additionally any interstices in the slider, to prevent the film from being pushed into these interstices and thereby deformed or ruptured.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
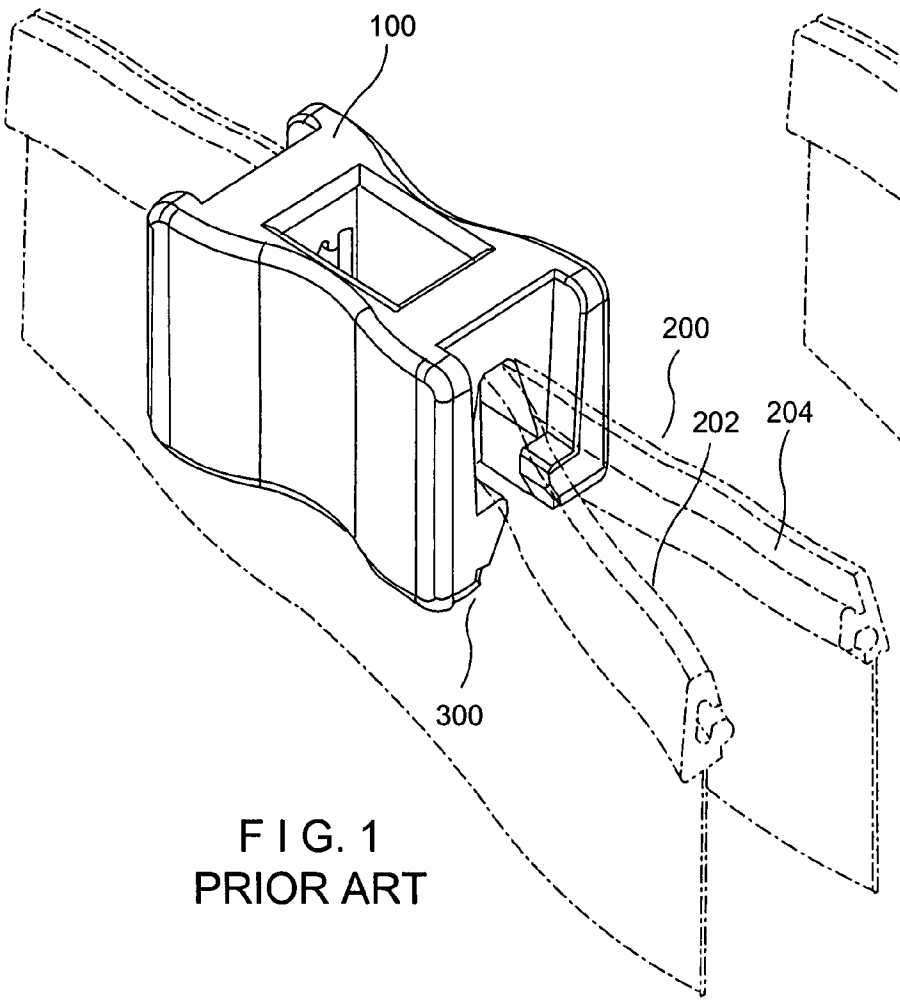
FIG. 1 PRIOR ART
FIG. 1 is a perspective view of a typical prior art slider, with the zipper profile shown in phantom.

Referring now to the drawings in detail wherein like numerals refer to like elements throughout the several views, one sees that FIG. 1 is a perspective view of prior art slider 100 with the zipper 200, formed from profiles 202, 204, shown in phantom. While it is the interstice 300 between slider 100 and profile 200 that is of the most concern during high pressure pasteurization, it can be seen that other interstices are formed on the slider 100 itself. These other interstices can be likewise problematic.

Figure 2:
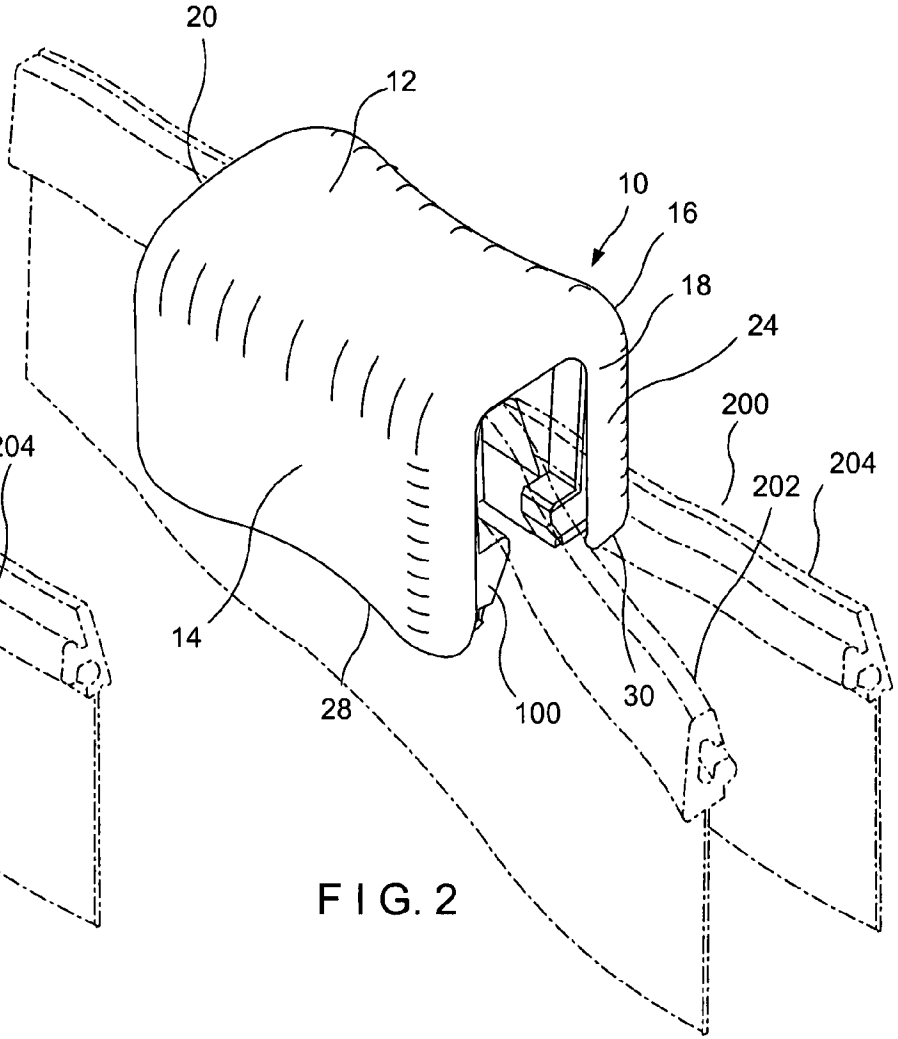
FIG. 2 is a perspective view of the sleeve cover of the present invention inserted over the slider of FIG. 1, with the zipper profile shown in phantom.

FIG. 2 shows the semi-soft sleeve cover 10 which is formed over slider 100. Sleeve cover 10 may be made from a semi-soft material such as silicone. However, those skilled in the art will recognize a range of equivalents. Sleeve cover 10 is typically molded over slider 100 during manufacture or attached by glue or other attachment methods, typically prior to delivery to a customer. However, in some applications, the assembly of the sleeve cover 10 to the slider 100 may be done at the customer's site.

Sleeve cover 10 includes rounded upper surface 12 which smoothly transitions to rounded side surfaces 14, 16. Ends 18, 20 of sleeve cover 10 are open to allow the passage of zipper 200. However, inwardly flanged surface 24 extends from upper surface 12 and rounded side surfaces 14, 16 around the ends of slider 100. Similarly, lower inwardly flanged surfaces 28, 30 are formed on rounded side surfaces 14, 16 to fill the interstices between the slider 100 and profiles 202, 204.

Sleeve cover 10 is in place as shown in FIG. 2, by molding, gluing or other attaching methods, prior to high pressure pasteurization wherein the reclosable bag, including contents such as meat or other foodstuffs, is placed into HPP equipment and pressurized. The sleeve cover can thereafter be removed prior to shipping or even by the consumer.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A sleeve cover for a zipper slider which includes a top wall around side walls surrounding the slider and an inwardly flanged bottom surface around the ends of the side walls, said sleeve cover being made of a material to fill interstices formed on the zipper slider and between the zipper slider and zipper elements when subjected to high pressure pasteurization, thereby preventing bag film from entering the interstices.

2. The sleeve cover for a zipper slider of claim 1 wherein ends of said sleeve cover are open and inwardly flanged end surfaces extend from said top wall and said side walls into a portion of said ends.

3. The sleeve cover for a zipper slider of claim 1 wherein said sleeve cover is molded over a zipper slider.

4. The sleeve cover for a zipper slider of claim 1 wherein said sleeve cover is glued to a zipper slider.

5. The sleeve cover of claim 1 wherein said sleeve cover is made from silicone.

6. The combination of a zipper slider and sleeve cover, said sleeve cover including a top wall around side walls surrounding the slider and an inwardly flanged bottom surface around the ends of the side walls, said sleeve cover being made of a material to fill interstices formed on the zipper slider and between the zipper slider and zipper elements when subjected to high pressure pasteurization, thereby preventing bag film from entering the interstices.

7. The combination of claim 6 wherein ends of said sleeve cover are open and inwardly flanged end surfaces extend from said top wall and said side walls into a portion of said ends.

8. The combination of claim 6 wherein said sleeve cover is molded over said zipper slider.

9. The combination of claim 6 wherein said sleeve cover is glued to said zipper slider.

10. The combination of claim 6 wherein said sleeve cover is made from silicone.

* * * * *